000023 0267 -00 05-05-81 34006 03-30-81 162545 78147.0 04265228 0794

United States Patent [19]
Zoll
[11] 4,265,228
[45] May 5, 1981

[54] MECHANICAL PACEMAKER

[76] Inventor: Paul M. Zoll, 261 Brookline St., Newton, Mass. 02192

[21] Appl. No.: 67,411

[22] Filed: Aug. 17, 1979

Related U.S. Application Data

[63] Continuation of Ser. No. 942,363, Sep. 14, 1978, abandoned, which is a continuation of Ser. No. 802,135, May 31, 1977, abandoned.

[51] Int. Cl.³ ..... A61H 23/00
[52] U.S. Cl. ..... 128/55
[58] Field of Search ..... 128/51-55, 128/41, 24.1, 24.2

[56] References Cited

U.S. PATENT DOCUMENTS

| | | | |
|---|---|---|---|
| 3,396,721 | 8/1968 | Mencacci | 128/41 |
| 3,896,797 | 7/1975 | Bucur | 128/53 |
| 3,955,563 | 5/1976 | Maione | 128/55 |

FOREIGN PATENT DOCUMENTS

| | | | |
|---|---|---|---|
| 1902760 | 8/1970 | Fed. Rep. of Germany | 128/55 |

*Primary Examiner*—John D. Yasko

[57] ABSTRACT

A mechanical pacemaker for impacting on the outside of the chest to provide cardiac stimulation in which impact means drive an impact surface in discrete impacts against the chest, with circuitry to actuate the impact means in response to the electrical output of a cardiac monitor.

5 Claims, 5 Drawing Figures

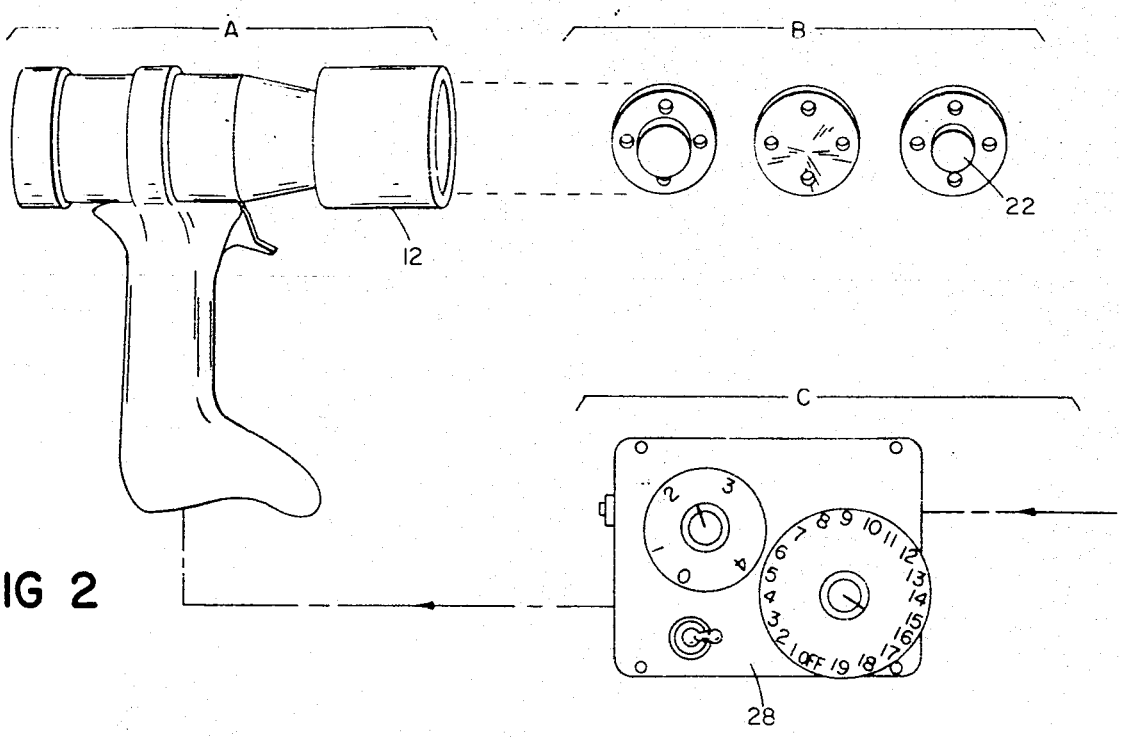
FIG 2
FIG 3
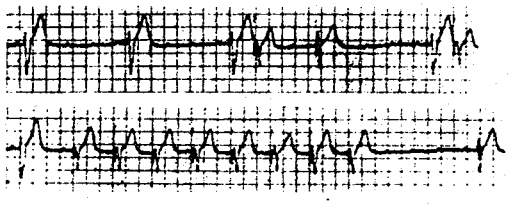
FIG 4
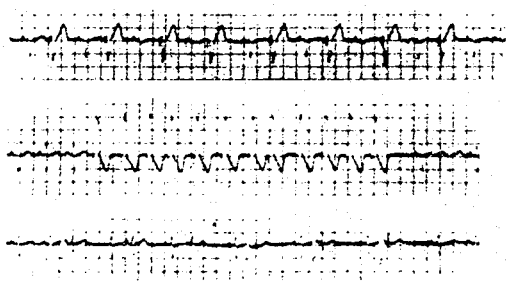
FIG 5
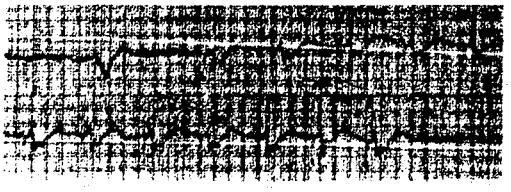

MECHANICAL PACEMAKER

This is a continuation of application Ser. No. 942,363, filed Sept. 14, 1978, now abandoned which is a continuation of application Ser. No. 802,135, filed May 31, 1977, now abandoned.

FIELD OF THE INVENTION

This invention relates to cardiac pacemakers, particularly for quick and temporary use.

BACKGROUND OF THE INVENTION

It is often important to be able quickly to stimulate a heart beat. It is known that this can be done externally, both with a blow of a surgeon's fist and electrically. The former, however, not only has limitations of reliability and frequency, but involves real risk of physical harm to the patient. The latter involves pain not tolerable usually to conscious patients.

SUMMARY OF THE INVENTION

I have discovered that a mechanical device adapted to deliver blows of predetermined energy to the chest wall, in a predetermined pattern, provides external, noninvasive stimulation of the heart which is quick, safe, easily applied, reliably effective, and well tolerated by a conscious patient.

DESCRIPTION OF PREFERRED EMBODIMENT

Figure 1:
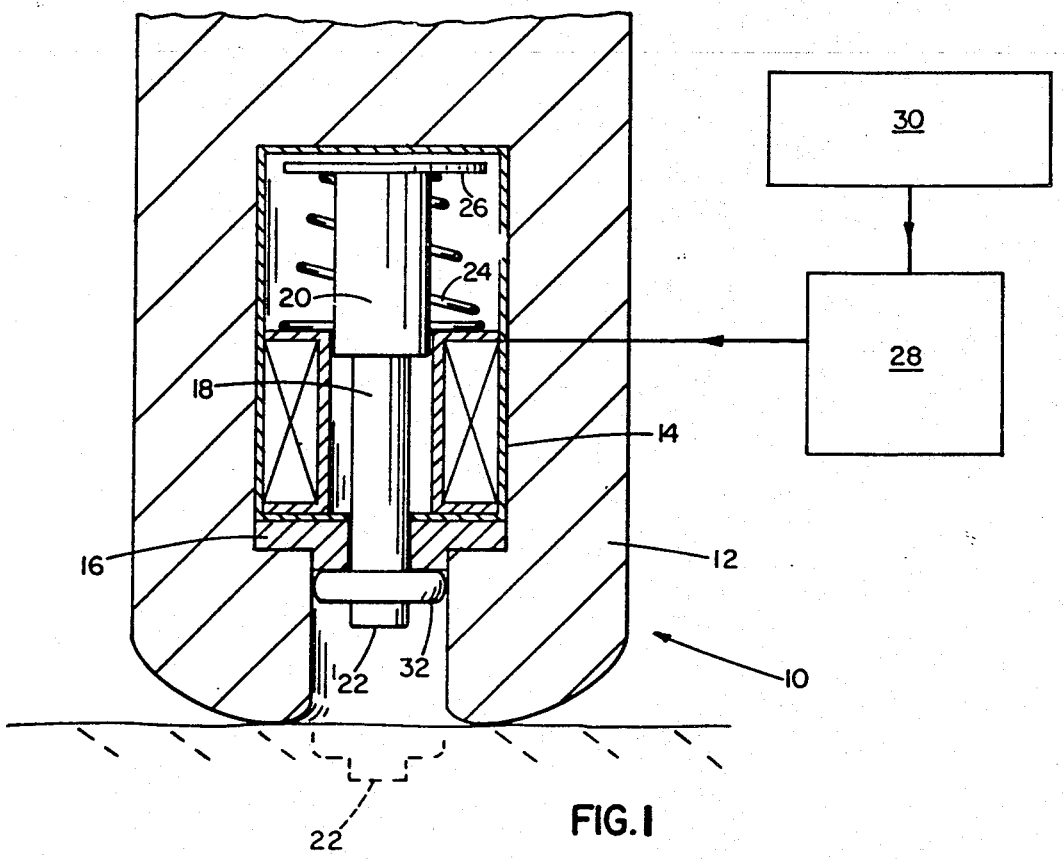

FIG. 1: Shows a broken-away, somewhat diagrammatic view of a preferred embodiment of the invention.
FIG. 2: Initial Model of a Mechanical Pacemaker. A shows the modified electrically powered stapling gun, B three impact heads with varying impact surfaces, and C the control box containing potentiometers and synchronizing switch.

FIG. 3: Electrocardiogram in a Dog with Complete Heart Block. In the upper strip, the first two mechanical stimuli, marked by the linear spike artifacts, fall in the refractory period near the end of the T waves and are ineffective. The next three stimuli, falling later in the relative refractory or recovery periods, produce ectopic ventricular beats. In the lower strip a series of eight stimuli at 0.60-second intervals produces a run of externally paced ventricular tachycardia.

FIG. 4: Electrocardiogram in a Dog with Normal Sinus Rhythm. In the upper strip, mechanical stimuli applied 0.32 second after normally conducted beats produce ectopic ventricular beats in bigeminal pattern. In the middle strip, a sequence of 12 mechanical stimuli produce a run of ventricular tachycardia at 150 per minute. In the lower strip, mechanical stimuli 0.16 second after normally conducted beats produce atrial bigeminy; they do not evoke ectopic ventricular beats since they are in the refractory period of the preceding QRS-T, but they are late enough after the preceding P waves to produce premature atrial beats that are then normally conducted.

FIG. 5: Electrocardiogram in a Patient in Cardiac Arrest, Showing Sporadic Ventricular Beats Interrupted by a Run of Ventricular Rhythm at 100 per Minute Stimulated by the External Mechanical Pacemaker.

STRUCTURE

The mechanical pacemaker indicated generally at 10 (broken away) a handle may be included if desired) includes housing 12 in which solenoid 14 is mounted on support 16 in which plunger 18 is reciprocally mounted. Plunger 18 includes inertial mass 20 and chest impact surface 22, and weighs 200 grams. Surface 22 is two centimeters in diameter. Spring 24 acting against plunger portion 25 biases the plunger into the position shown in the drawing in solid lines. Driving and timing circuitry 28 is provided. A cardiac monitor 30 is connected for selective control.

OPERATION

Circuitry 28 energizes solenoid 14 to drive surface 22 against the chest wall as predetermined. Surface 22 travels one centimeter beyond housing 12. Circuitry 28 provides for predetermined actuation of the plunger to drive surface 22 against the chest wall in single impacts each pursuant to the pull of a manual trigger (not shown), in an asynchronous way, or in a standby or demand mode, responsive to cardiac monitor 30. Rate may be controlled by circuitry 28 at from 30 impacts per minute to 200.

INCORPORATION BY REFERENCE

I incorporate the following disclosure from an article, published June 3, 1976 in the *New England Journal of Medicine,* "External Mechanical Cardiac Stimulation", of which I was one co-author.

Temporary cardiac stimulation in the emergency resuscitation from cardiac arrest and in other less urgent conditions is generally applied by way of a pervenous endocardial electrode and an external electric pacemaker. Search for a more quickly and easily applied, noninvasive, reliably effective, safe and well tolerated method of temporary cardiac stimulation has led us to re-examine external electrical and mechanical stimulation. The technique of external electric stimulation was developed in 1950 and was applied successfully in man in 1952. (Zoll PM: Resuscitation of the heart in ventricular standstill by external electric stimulation. N Engl J Med 247:768–771, 1952.) Electric pacemakers for both external and direct cardiac stimulation are still in use. (TR-3 from B-D Electrodyne Co., Sharon, MA.) This method meets all requirements listed, except that it is usually not well tolerated by the conscious patient. Its usefulness is not limited to Stokes-Adams disease and atrioventricular block, as is frequently erroneously stated. Just as with direct myocardial or endocardial electric stimulation, it is capable of exciting ventricular beats and resuscitating patients from ventricular standstill or bradycardia of any cause, if the heart is still able to contract effectively. Competitive external stimulation even in the vulnerable phase after intrinsic beats does not produce repetitive responses, tachycardia or fibrillation. In recent years, however, it has been largely neglected and is usually not applied even in most advantageous circumstances, as in unconscious patients during cardiac arrest or anesthesia.

External mechanical stimulation has long been used as an initial emergency procedure in ventricular standstill. In a series of 20 experiments in dogs with normal rhythm and high-degree atrioventricular block we have demonstrated the effectiveness of mechanical stimuli in evoking heart beats, have measured the threshold for response, and have examined factors that may influence the threshold (unpublished data).

Initially, the mechanical stimuli were provided by the fall of a hammer from measured heights over the precordium; later, weights were dropped down calibrated transparent tubes. Finally, a prototype external mechanical pacemaker or "cardiac thumper" was constructed and calibrated for us from an industrial electric stapling gun by Professor Igor Paul, of the Massachusetts Institute of Technology (FIG. 2). The mechanical stimuli were produced by the activation of a solenoid with an electric current that makes a small linear artifact in the electrocardiogram and provides accurate timing of the impulse. The current was released by a manually operated trigger or by a signal from a cardiac monitor so that stimuli could be synchronized to fall at any desired interval after an R wave.

The area of the impact surface, the mass of the projectile (and therefor its velocity) and the locations of impact on the precordium were varied empirically, and the features most effective in producing responses at lowest energies were chosen. We found the lowest thresholds at 0.04 to 0.7 J, using a 250-g projectile with an impact surface 2 cm in diameter over a rib or an intercostal space medial to the cardiac apex.

The externally applied mechanical stimuli produced effective cardiac beats just as electric stimulation is known to do, but the widespread, painful stimulation of skeletal muscles was absent. Local and cardiac tissue damage was also present except for minimal subcutaneous petechiae after prolonged intense stimulation. Single atrial and ventricular beats and repetitive beats in runs of tachycardia or in other patterns were readily evoked (FIG. 3 and 4).

External mechanical stimulation reproduced all the features of ventricular excitability that were seen with electric stimulation. The various phases of the absolute and relative refractory and supernormal and complete recovery periods were readily demonstrated with synchronized mechanical stimuli. Repetitive responses, tachycardia and fibrillation were not observed, however, even with stimulation in the relative refractory period at energies 10 times threshold levels.

In four exploratory experiments the time of arrival of the mechanical wave of disturbance at or near the heart was recorded with a pick-up device in the trachea or esophagus. In every experiment a constant interval of 40 msec between the mechanical stimulus and the electrical ventricular response was recorded. The implications of this interval—i.e., the nature of the process by which the mechanical wave produced electrical excitation at the myocardial cell membrane—are not known.

External mechanical cardiac stimulation was also applied in 10 human subjects after the procedure was carefully explained and informed consent was obtained. An exception was one case of cardiac arrest in which it was not possible to obtain consent before emergency application. These were all patients in whom external cardiac stimulation was considered a necessary, potentially useful measure. In on patient with ventricular asystole and prolonged anoxia that followed termination of ventricular fibrillation, ventricular beats were evoked, but effective circulation could not be restored (FIG. 5). In two patients with atrial fibrillation mechanical stimuli were applied in preparation for external defibrillation to demonstrate their effectiveness in case asystole followed the countershock. In six patients with high-degree atrioventricular block in whom cardiac pacemakers were to be newly implanted or replaced, mechanical stimuli were also applied to demonstrate their effectiveness in case of asystole during the procedure. Prophylactic insertion of a temporary endocardial electrode was thereby avoided. In an additional subject with normal sinus rhythm who was undergoing hemodynamic study, mechanical stimuli were applied to provoke premature ventricular beats. In all but two of these patients mechanical stimulation was successful in provoking ventricular beats with no untoward cardiac effects. In these two failures varying technical difficulties prevented an adequate trial. Thresholds for ventricular responses ranged from 0.04 to 1.5 J. In all patients the effective stimuli were felt as somewhat unpleasant, but well tolerated precordial impulses. Severe discomfort was reported at 2.0 J by one patient; four patients tolerated 3 J without complaint of pain.

These observations indicate that external mechanical stimulation of the heart is indeed a quick, safe, easily applied, reliably effective, and well tolerated method of temporary cardiac stimulation. It may provide a noninvasive means of prompt stimulation of atrial or ventricular beats for any purpose. It should make unnecessary the pervenous passage of a temporary "catheter" electrode during the emergency of cardiac arrest or as a prophylactic measure whenever asystole is feared.

CONCLUSION

Other embodiments will occur to those skilled in the art. For example, portion 32 carrying surface 22 may be made selectively detachable, so that weight and surface size and shape may be selectively varied.

What is claimed is:

1. A mechanical pacemaker for contacting the chest to provide cardiac stimulation, comprising:

a housing having a chest-contact surface, and a cavity with an opening in said chest-contact surface;

an impact surface on one end of a plunger slidably mounted within said cavity such that a travel path for said impact surface is defined, said path extending outside said housing and through said opening and said impact surface being located outside of said housing at one end of said travel path and inside said housing at the other end of said path, said impact surface being shaped and sized to achieve deformation of the chest when travelling outside said housing;

an impact means for driving said impact surface in discrete impacts that make and break contact with the chest, said impact means being operably connected to said impact surface by said plunger, said impacts being of a predetermined reproducible energy delivery selected to fail within an energy range, the lower end of said range being sufficiently high to achieve cardiac stimulation and the upper end being sufficiently low to avoid causing intolerable pain; and an electronic circuit means for actuating said impact means in response to the electrical output of a cardiac monitor, said actuation being synchronized to occur in a desired phase relation with the heart beat, to thereby produce a desired electrical ventricular response to the mechanical impacts.

2. The pacemaker of claim 1 in which said energy range is from 0.04 to 5 joules of kinetic energy.

3. The pacemaker of claim 1 in which said impact means includes a solenoid.

4. The pacemaker of claim 1 in which the energy delivered by said impact surface is adjustable.

5. The pacemaker of claim 2 in which said energy range is from 0.5 to 5 joules of kinetic energy.

* * * * *